US005740886A

United States Patent [19]

Fletcher

[11] Patent Number: 5,740,886

[45] Date of Patent: Apr. 21, 1998

[54] METHOD OF RETROFIT OF IN-GROUND AUTOMOTIVE LIFT SYSTEM

[75] Inventor: Robert H. Fletcher, San Diego, Calif.

[73] Assignee: Advantage Lift Systems, Inc., San Diego, Calif.

[21] Appl. No.: 683,305

[22] Filed: Jul. 18, 1996

[51] Int. Cl.[6] ..... B66F 7/00

[52] U.S. Cl. ..... 187/205; 254/89 H

[58] Field of Search ..... 187/210, 205, 187/218, 268, 267; 254/93 L, 92, 89 H

[56] References Cited

U.S. PATENT DOCUMENTS

| | | | |
|---|---|---|---|
| D. 343,488 | 1/1994 | Fletcher | D34/28 |
| 1,870,128 | 8/1932 | Lunati . | |
| 1,889,185 | 11/1932 | Stukenborg . | |
| 1,899,534 | 2/1933 | Steedman . | |
| 1,915,024 | 6/1933 | Logette et al. . | |
| 3,061,044 | 10/1962 | Shotmeyer . | |
| 3,892,292 | 7/1975 | Takenoshita et al. | 187/17 |
| 4,022,428 | 5/1977 | Mantha | 254/89 R |
| 4,687,078 | 8/1987 | Wilson | 187/17 |
| 4,700,748 | 10/1987 | Fossati et al. | 137/877 |
| 4,726,450 | 2/1988 | Fossati et al. | 187/111 |
| 4,763,761 | 8/1988 | McKinsey et al. | 187/8.41 |
| 4,830,146 | 5/1989 | Nakamura et al. | 187/26 |
| 4,830,147 | 5/1989 | Kawada | 187/8.62 |
| 4,848,732 | 7/1989 | Rossato | 254/90 |
| 5,014,824 | 5/1991 | Fargo | 187/17 |
| 5,050,844 | 9/1991 | Hawk | 254/89 |
| 5,096,159 | 3/1992 | Fletcher | 254/90 |
| 5,099,956 | 3/1992 | Curran | 187/8.41 |
| 5,190,122 | 3/1993 | Fletcher et al. | 187/8.5 |
| 5,199,686 | 4/1993 | Fletcher | 254/90 |
| 5,259,482 | 11/1993 | Proulx et al. | 187/8.62 |
| 5,299,658 | 4/1994 | Cox et al. | 187/8.41 |
| 5,322,143 | 6/1994 | Curran | 187/8.49 |
| 5,404,968 | 4/1995 | Fletcher | 187/205 |
| 5,501,296 | 3/1996 | Fletcher | 187/210 |
| 5,518,220 | 5/1996 | Bertrand et al. | 254/7 B |
| 5,573,083 | 11/1996 | Fletcher et al. | 187/205 |

FOREIGN PATENT DOCUMENTS 9631292 10/1996 WIPO .

OTHER PUBLICATIONS

Benwill Grand Prix Automotive Lift Systems, Benwill Industries Inc. (Mar. 1996).

JAB Brochure—2–Bis 4–Stempel–Hebebuhnen, J.A. Becker & Sohne, Maschinenfabrik, Postfach 1151, 74148 Neckarsulm, Tel. 07132–3670, Fax 07132, 36787, pp. 1–15 (1995).

(List continued on next page.)

*Primary Examiner*—Kenneth Noland

*Attorney, Agent, or Firm*—Stephanie L. Seidman; Brown Martin Haller & McClain LLP

[57] ABSTRACT

A method of retrofit includes the steps of removing the pre-existing superstructure of the lift system. A hole is then cut in the encasement securing the upper portion of the pre-existing casing. Thereafter, all hydraulic fluid is drained. Thereafter, the pre-existing gland flange is removed. The old plunger is also removed. After the same has been accomplished, there is then provided a high pressure low volume hydraulic cylinder and associated hydraulic line, all of which is positioned within the casing of the pre-existing system. The bottom of the high pressure hydraulic cylinder is mechanically locked to the base of the pre-existing outer casing. A new pump and hydraulic lines are then installed. A new plunger is then added to the new hydraulic cylinder and, with it, an appropriate bearing and guide mechanism which uses the pre-existing casing as an outer guide means for the new plunger. Alternatively, an upper bearing structure is then provided between the top of the pre-existing casing and the new plunger. The hole cut in the concrete encasement is filled with newly placed concrete. The pre-existing superstructure is then secured to the top of the new plunger and cylinder structure.

7 Claims, 14 Drawing Sheets

OTHER PUBLICATIONS

Gibraltar Auto Lifts, Tulsa, OK, 1–800–364–5438 (1995).
MonoRam MP & LP Lifts, J.A. Becker & Sohne, P.O. Box 1151, D–74148 Neckarsulm, Phone: + 49(0) 7132 / 3 67—0, Fax: + 49 (0) 7132 / 3 67 89, Telex: 728 863 (1995).
TwinRam, J.A. Becker & Sohne, Postfach 1151, D–74148 Neckarsulm, Phone: + 49 (0) 7132 / 3 67—0, Fax: + 49 (0) 7132 / 3 67 89, Telex: 728 863 (1995).
Stenhoj All–Purpose Lift, Stenhoj, DK–7150 Barrit, Phone: + 45 75 691222, telex: 60644 stnhj, telefax + 45 75 691035 (1995).
SLIFT Car Lifts, SLIFT Frank E. Sommerer (1995).
Nusbaum brochure—Top–Lift, Nusbaum Hebetechnik, Otto Nusbaum GmbH & Co., KG, 77694 Kehl–Bodersweier (1995).
Drawing, J.A. Becker & Soehne, Maschinefabrik, 74148 Neckarsulm.
Drawing, Challenger Lifts, 1402 West Main, Louisville, KY 40201.
Drawing (German language), Aie Anbindung des Rehmans en die, Bodenplatte kann nur durcl en orlichen, Architekten/ Slatiker beurleilt werden.

METHOD OF RETROFIT OF IN-GROUND AUTOMOTIVE LIFT SYSTEM

BACKGROUND OF THE INVENTION

The present invention relates to in-ground hydraulic lifts for automotive vehicles and, more particularly, to a method of retrofit of so-called low pressure high volume hydraulic systems to construct so-called high pressure low volume systems.

In a typical in-ground hydraulic lift system, that is, a system known as a low pressure high volume lift system, forty to sixty gallons of hydraulic fluid, at a pressure of 100 to 125 psi are required to raise a car, and 120 to 150 gallons of hydraulic fluid at said pressure of 100 to 250 psi, are required to raise a truck or bus. In recent years, an understanding has developed that the utilization of such large quantities of hydraulic fluid give rise to environmental concerns of substantial proportion.

More particularly, hydraulic fluid, while for the most part comprising an oil-based hydrocarbon carbohydrate, can include certain caustic and heavy metal additives including iron, lead, copper, tin, aluminum, nickel, phosphorus, molybdenum and cadmium. These additives, if permitted to penetrate the water table, can give rise to contamination of the water supply at concentrations of only a few parts per billion. There is, thereby, a burgeoning awareness on the part of environmental officials and others that the in-ground hydraulic lift, which has been a standard in service stations throughout the world since the 1920's, presents an actual and/or potential health hazard of still unmeasured magnitude.

The above problem, as may be appreciated, is more acute in areas where the water table is very high, such as in coastal areas of Florida, Georgia and Louisiana where the water table can be as high as three feet below the surface. Thereby, the typical prior art in-ground hydraulic lift, which is installed to a depth of about nine feet in the ground, presents a particularly serious hazard in such areas.

One solution to the above problem is the complete elimination of hydraulic fluid in an inground lift system. Such a solution appears in U.S. Pat. No. 5,404,968 held by the within inventor Robert H. Fletcher.

Another solution which has been proposed to the problem of leakage of hydraulic fluid into the ground and water table has been that of reducing the volume of hydraulic fluid used in lift systems such that the containment problem becomes an easier one to address. Associated with such a reduction in volume of hydraulic fluid is an increase in the fluid pressure which must be applied to the hydraulic fluid. In a typical high pressure low volume lift system, a volume of 2.5 gallons of hydraulic fluid, at a pressure of 2,500 psi, can raise a car, and six gallons of hydraulic fluid, at the same pressure, can raise a truck or bus. Accordingly, it may be seen that in applications such as the lifting of a bus, truck or other heavy duty vehicles, the quantity of fluid required can be reduced to about three percent of that required in a traditional low pressure, high volume system.

The benefits of such a high pressure system, in addition to the obvious benefits of reduced hazard to the environment, is that it is a simpler engineering matter to contain small mounts of hydraulic fluid, and such a high pressure low volume system can operate in a containment that renders repairs or removal much easier than is the case in traditional systems.

Such high pressure low volume systems are known in the art and are commercially offered by Nusbaum of Germany, Stenhoj of Sweden, and Rotary in the United States. These systems are, for the most part, ones which require a service station to excavate the massive concrete and steel structure associated with traditional low pressure high volume systems and replace the low pressure with high pressure systems. Therefore, as a practical matter, the use of high pressure lift systems is cost-effective only for new service stations or new auto repair facilities.

In view of the above, the concept of attempting to retrofit an existing low pressure high volume system to resultingly convert the same into a state-of-the-art high pressure system has been discussed. However, to the knowledge of the present inventor, only at a conceptual level and, without any actual reduction to practice thereof ever having occurred. Accordingly, the lift industry has recognized the desirability of finding a viable method of low pressure to high pressure conversion. However, attempts at developing such a method have been feeble at best.

It is, accordingly, as a response to this recognized need in the art for a viable retrofit method for conversion of low pressure to high pressure hydraulic lift systems that the instant invention is directed.

SUMMARY OF THE INVENTION

The instant inventive method of retrofit of a pre-existing in-ground automotive lift includes the steps of removing the pre-existing superstructure of the lift system, partial excavation of the concrete floor slab securing the upper portion of the pre-existing lift casing, and draining the prior system until all hydraulic fluid is removed. Thereafter the pre-existing gland flange is removed. Thereafter, the old plunger is also removed. A hole is then drilled through the upper portion of the existing lift casing to allow connection of the new high pressure hydraulic cylinder. There is then provided a self-contained high pressure low volume hydraulic cylinder and associated hydraulic line, all of which is positioned within the casing of the pre-existing system. Thereafter, the new hydraulic line is passed through, and secured to, the hole previously drilled in the existing lift casing. The bottom of the high pressure hydraulic cylinder is then mechanically locked to the base of the pre-existing outer casing. Thereafter a new plunger is added to the new hydraulic cylinder and, with it, an appropriate bearing and guide mechanism which uses the pre-existing casing as an outer guide means for the lower portion of the new plunger. A liner material may be added to the existing lift casing to create a smooth surface on which the lower bearing of the new plunger may ride. A bearing housing with bearing means and securing means is then provided between the top of the new plunger and the pre-existing gland flange, which is then replaced upon the existing casing. Alternatively, a bearing surface may be interfaced with a new gland flange that supports both upper and lower bearing means, substituting for the lower bearing means on the new plunger. A new power unit is then installed and connected to the new hydraulic line through a suitable containment raceway positioned below the concrete floor and exiting the concrete floor in the vacinity of the new power unit. Thereafter, the partial excavation of the concrete floor is filled with newly placed concrete. A breather element is then installed at the inlet point of the pre-existing hydraulic supply system. Alternately, a new breather system may be installed attaching to the lift casing at the oil inlet port and exiting the concrete floor at any convenient point within the shop area. The pre-existing superstructure is then secured to the top of the new plunger and cylinder structure.

It is, accordingly, an object of the invention to provide a method by which prior art low pressure high volume hydraulic automotive lift systems may be cost-effectively replaced by high pressure low volume systems.

It is another object of to provide a retrofit method which eliminates the need to completely excavate low pressure systems to be replaced.

It is a further object of the invention to provide a retrofit method of the above type that will reduce disruption to the service station work area during the retrofit process.

It is a yet further object to provide a retrofit method that will eliminate the possibility of exposing the property owner to the unwanted, and potentially liability creating fact, that the soil surrounding his pre-existing automotive lift system is contaminated.

It is a still further object of the invention to provide a retrofit method which may be readily adapted for use with a large variety of low pressure lift systems that have been manufactured and installed throughout the world over the past fifty years.

It is a yet further object to provide a method of retrofit which will make efficient use of components of pre-existing prior art low pressure high volume systems to further reduce the costs associated with said retrofit.

The above and yet other objects and advantages of the present invention will become apparent from the hereinafter set forth Brief Description of the Drawings and Detailed Description of the Invention herewith.

DETAILED DESCRIPTION OF THE INVENTION

Figure 1:
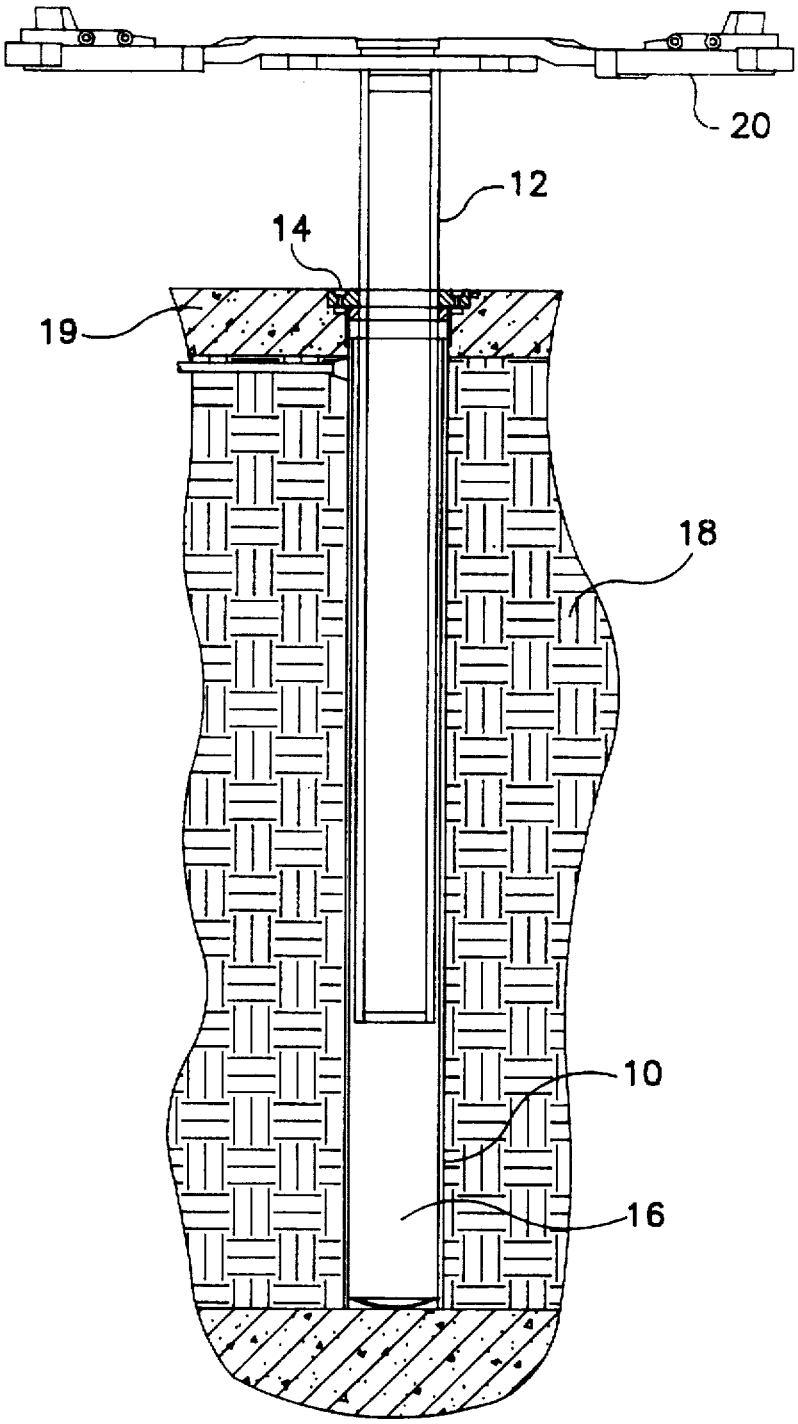
FIG. 1 is a vertical diametric view showing a pre-existing inground automotive lift system.

With reference to the vertical cross-sectional view of FIG. 1 there is shown a generic prior art low pressure high volume in-ground hydraulic automotive lift system. More particularly, in the view of FIG. 1 is shown a casing 10 of the pre-existing system, a plunger 12, a gland flange 14, a pressurized region 16 situated under and around plunger 12, this comprising the region within which most of the hydraulic fluid in low pressure high volume system is utilized. Further shown in FIG. 1 is a soil encasement 18, and concrete encasement 19 which surrounds casing 10, of the pre-existing system. In the initial step of the inventive method, said superstructure 20 is removed from the plunger 12, as is shown in FIG. 2 herewith.

Following removal of the superstructure, a hole or cavity 22 (see FIG. 2) is cut within the encasement 19, the purpose of which is to access the wall of casing 10.

Following cutting encasement 19, the fluid from the system including fluid in the old tank 31, (see FIG. 10) is evacuated and disposed.

Figure 2:
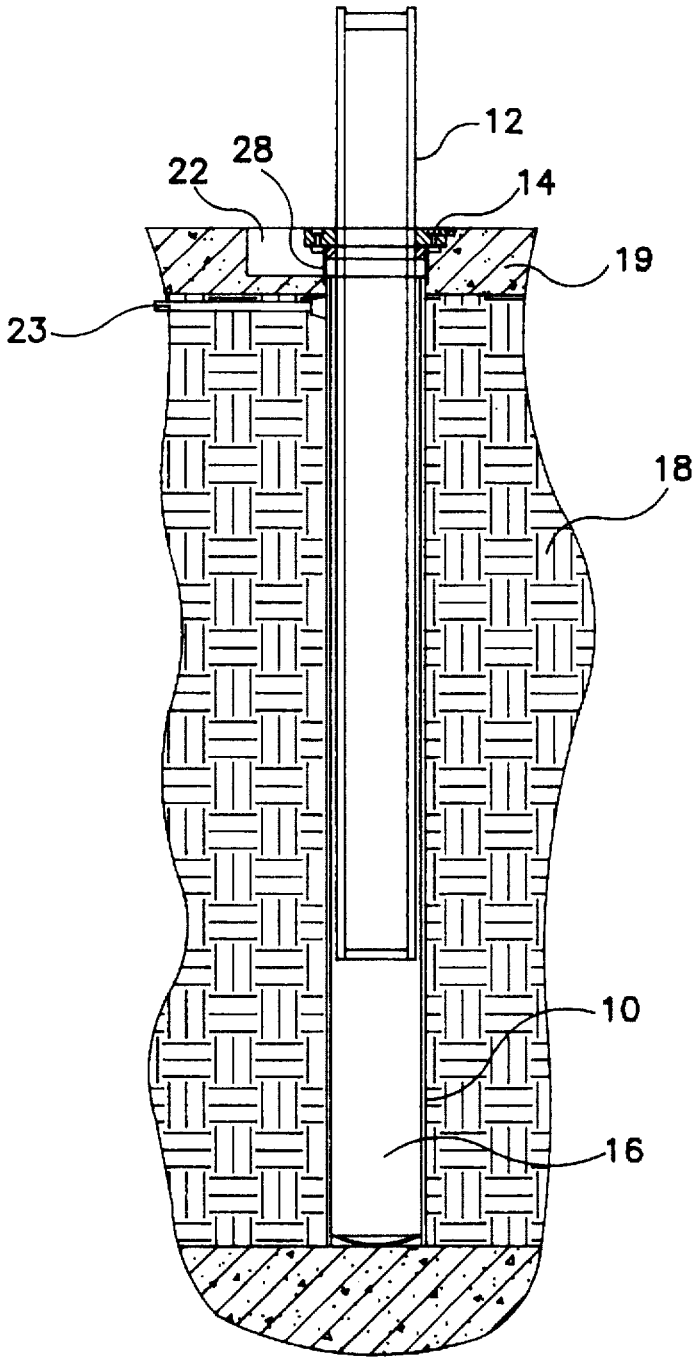
FIG. 2 is a view showing removal of the superstructure of the pre-existing system and partial excavation of the concrete structure surrounding the outer lift casing of the prior system.
Figure 3:
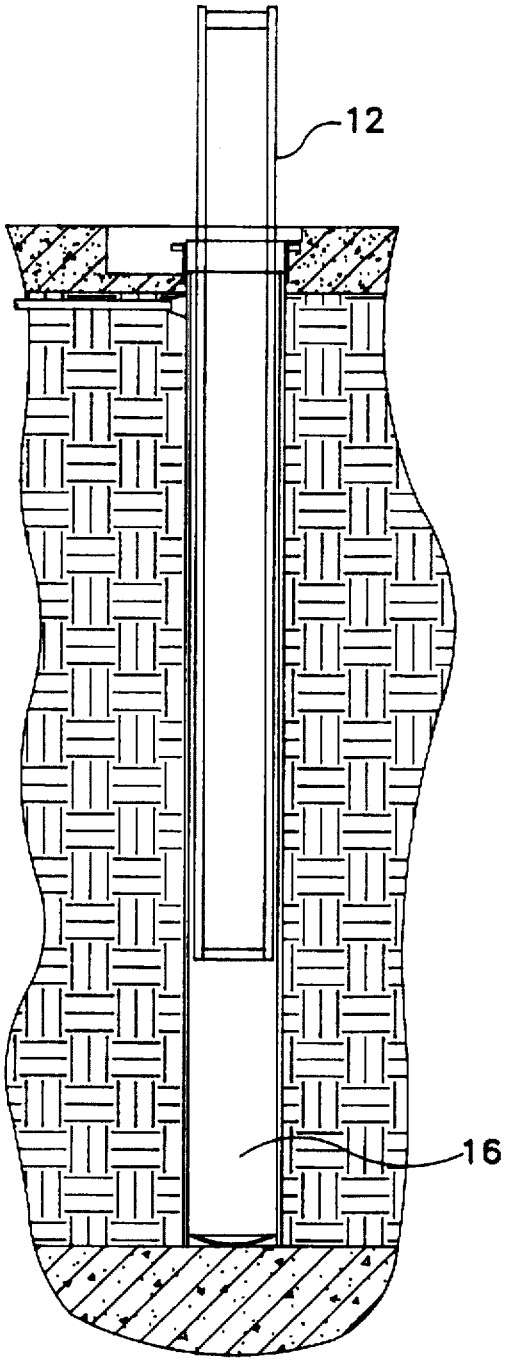
FIG. 3 is a view showing removal of the gland flange of the old system.
Figure 4:
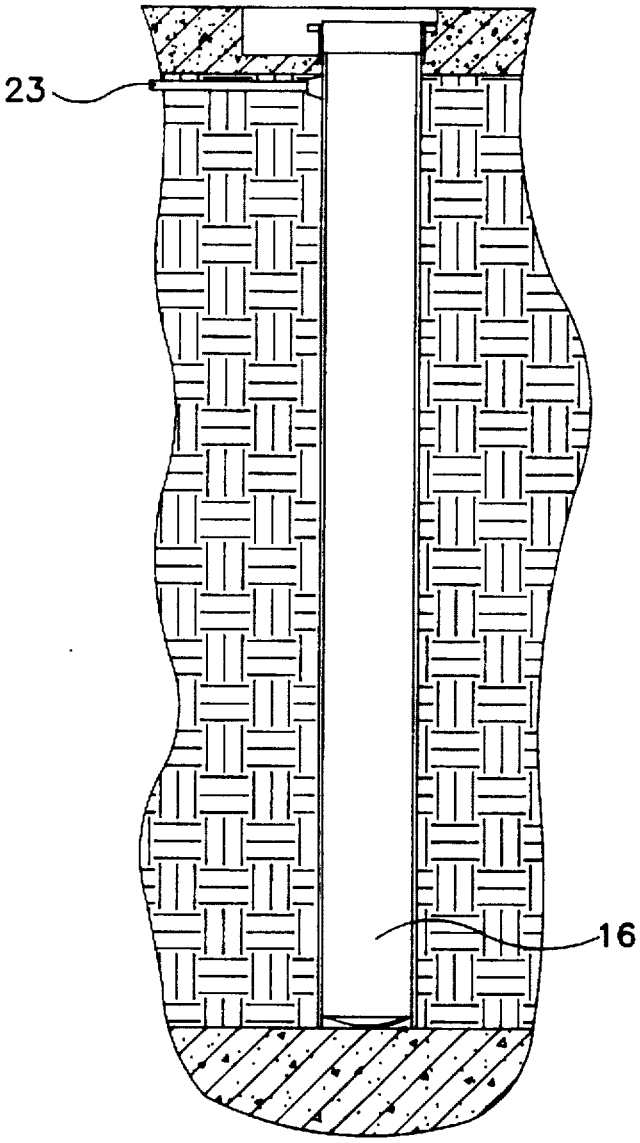
FIG. 4 is a view showing removal of the plunger of the old system.

Following the above steps, the gland flange 14 is removed, this followed by the removal of the original plunger 12 as is shown in FIGS. 2, 3 and 4. Thereafter, an access hole is drilled through the side of the casing in region 28 (see FIG. 2) of the prior system to provide an attachment point for the new hydraulic feed tube 29 (see FIG. 9). The old oil inlet port 23 (see FIG. 2) is thereby used as a breather hole to allow displaced air from region 16 to vent into tank 31 (see FIG. 10) of the old system and to cool the same.

It is noted that the old low pressure hydraulic line may be removed, and replaced with a suitable breather system exiting at any convenient point above the shop floor.

Following drilling an access hole in region 28, (see FIG. 2) there is a remaining structure which is shown in FIG. 4. At this point, installation of the new high pressure system can begin. This installation includes a new power unit 31 (see FIG. 9)

Figure 5:
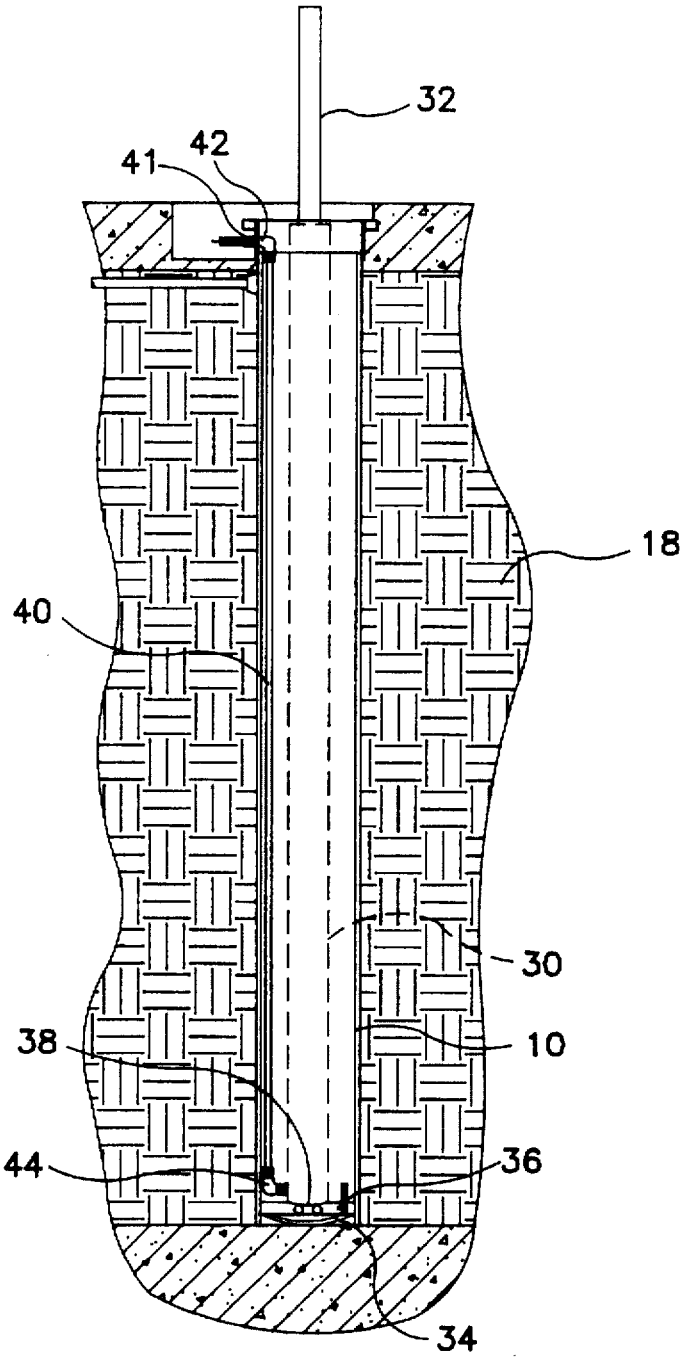
FIG. 5 is a vertical diametric view showing installation of the high pressure, low volume cylinder with associated hydraulic lines and securement of the cylinder to the base of the existing outer casing.

In the view of FIG. 5 is shown a new hydraulic cylinder 30 and its associated piston 32 which is secured to a bottom 34 of casing 10 through the use of a mounting plate 36 which operates to lock cylinder base 38 to the bottom of the existing outer casing 10. Accordingly, mounting plate 36 will also act to prevent rotation of new cylinder 30 relative to old casing 10 and encasement 18.

Further shown in FIG. 5 is the installation of new hydraulic line 40 which is fluidly supplied through inlet port 41. Accordingly, an input 42 to hydraulic line 40 is provided by pump 31 (see FIG. 9) and an output 44 of new fluid line 40 provides the necessary high pressure low volume input to base 38 of the high pressure cylinder 30.

Figure 6:
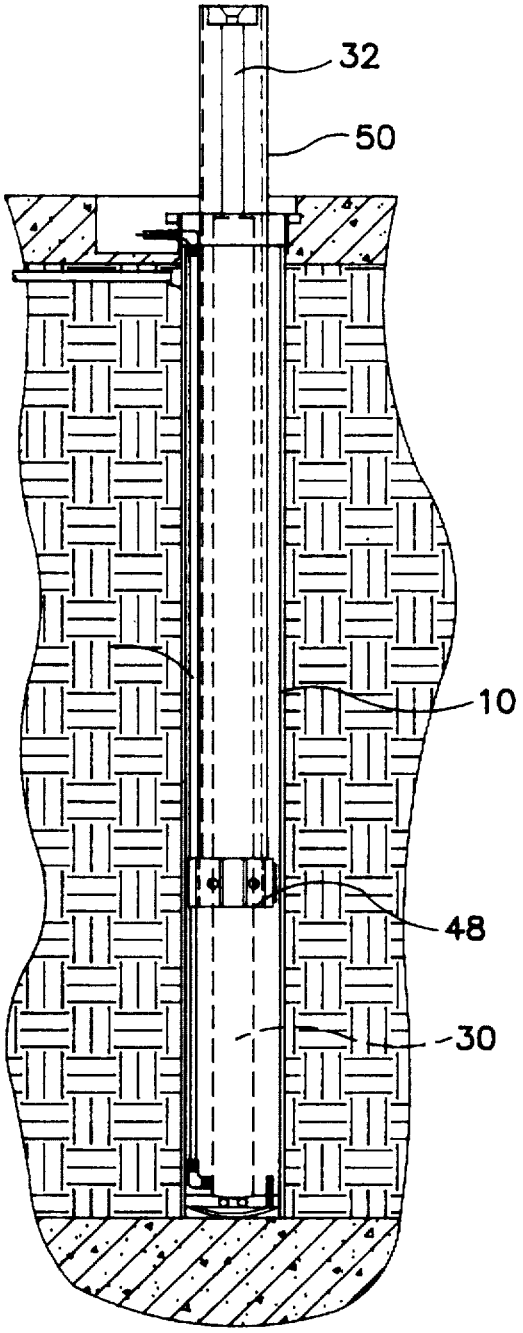
FIG. 6 is a further vertical diametric view showing insertion of the new plunger with integral lower plunger bearing means and bearing support means.

A further step in the present inventive retrofit method is shown in FIG. 6 which shows a collar-like bearing structure 48 that utilizes the existing casing 10 as an outer guide means for securing new plunger 50. Alternately, bearings may be positioned substantially about the top of casing. As may be noted, a plunger 50 (see FIG. 6) is secured upon the bearing guide collar 48 such that plunger 50 is lifted or lowered as a function of the movement of piston 32 within high pressure cylinder 30 without regard to the placement of the bearing means.

Figure 6A:
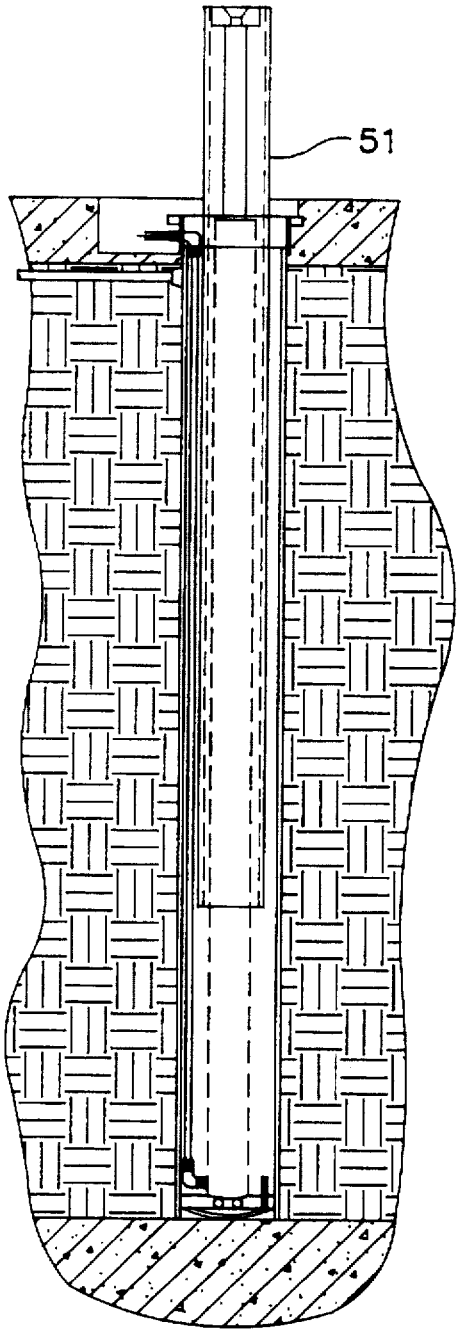
FIG. 6A is a further vertical diametric view showing insertion of the new plunger without integral plunger bearing means.

With reference to FIG. 6A it is noted that a new plunger 51 may be provided without a collar-like bearing structure by interfacing a new gland flange 53 (see FIG. 7A) that supports both upper bearing means 55, and lower bearing means 57.

Figure 7:
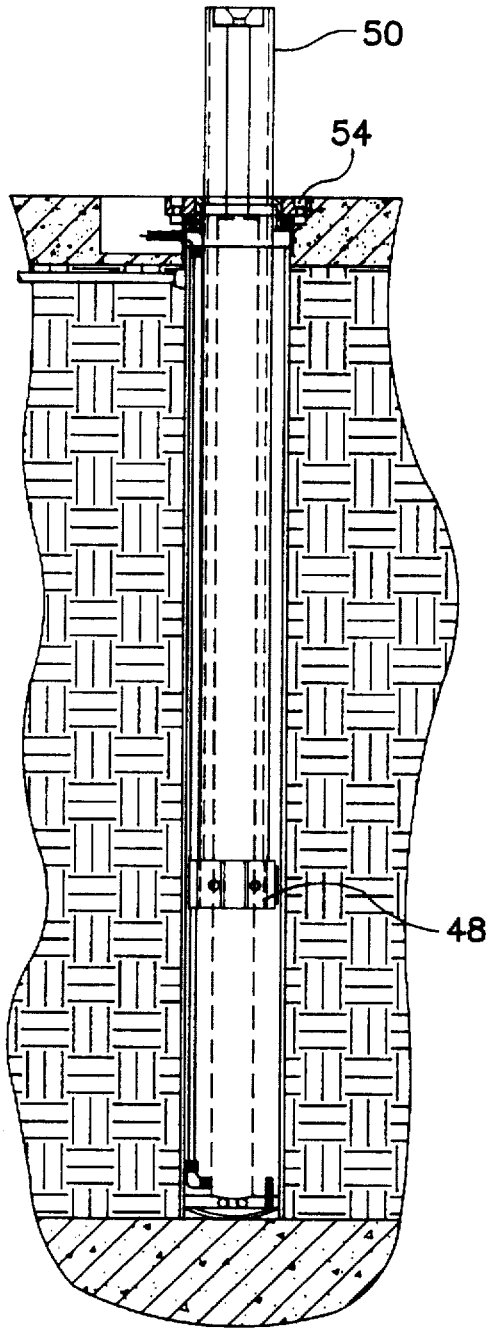
FIG. 7 is a view showing the addition of a new bearing housing with upper plunger bearing means attached to, and the re-installation of, the pre-existing gland flange.
Figure 7A:
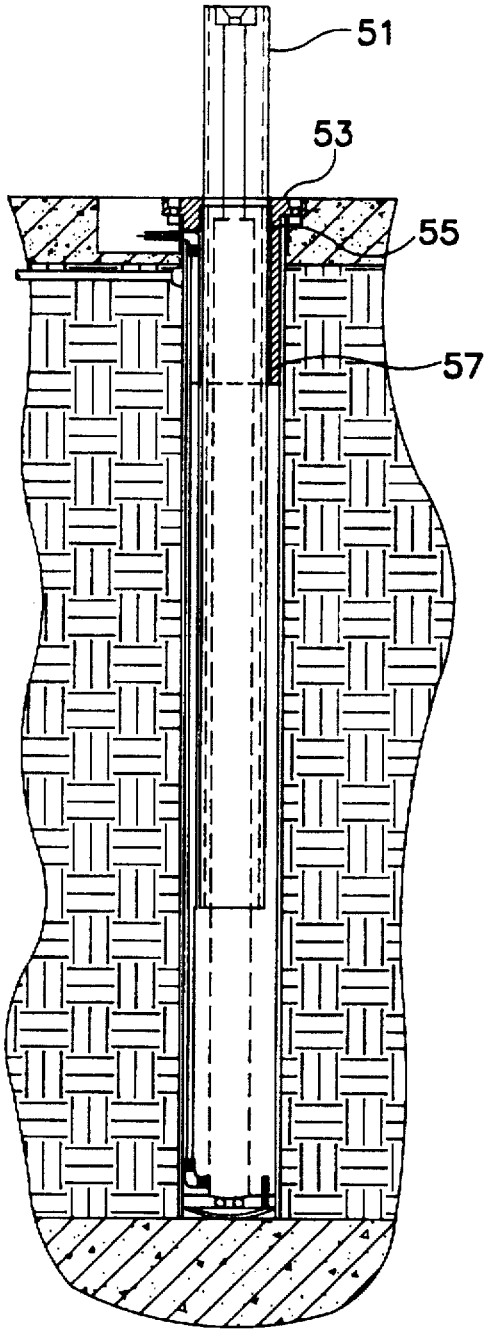
FIG. 7A is a view showing the addition of a new gland flange provided with integral upper and lower plunger bearing means.

With reference to FIG. 7 there is shown the insertion of an upper structure 54, the purpose of which is to stabilize new plunger 50 relative to said guide collar 48. Accordingly, the combination of new bearing housing 54 and said bearing guide collar 48 yields an operable high pressure low volume lift structure which is, in all respects, equivalent in mechanical function to that of the original low pressure high volume system shown in FIG. 1.

Figure 8:
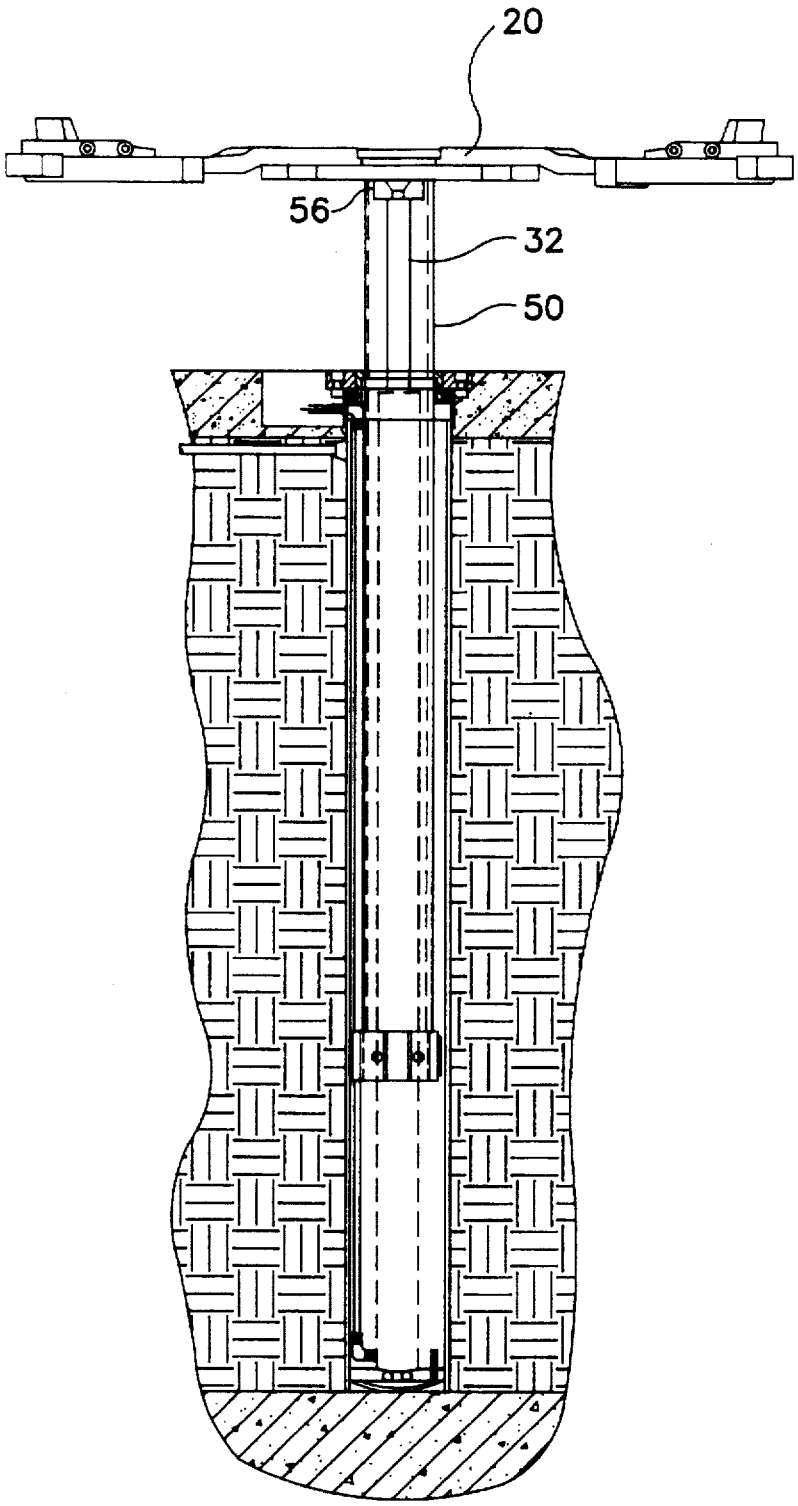
FIG. 8 is a view showing the installation of the pre-existing superstructure.
Figure 9:
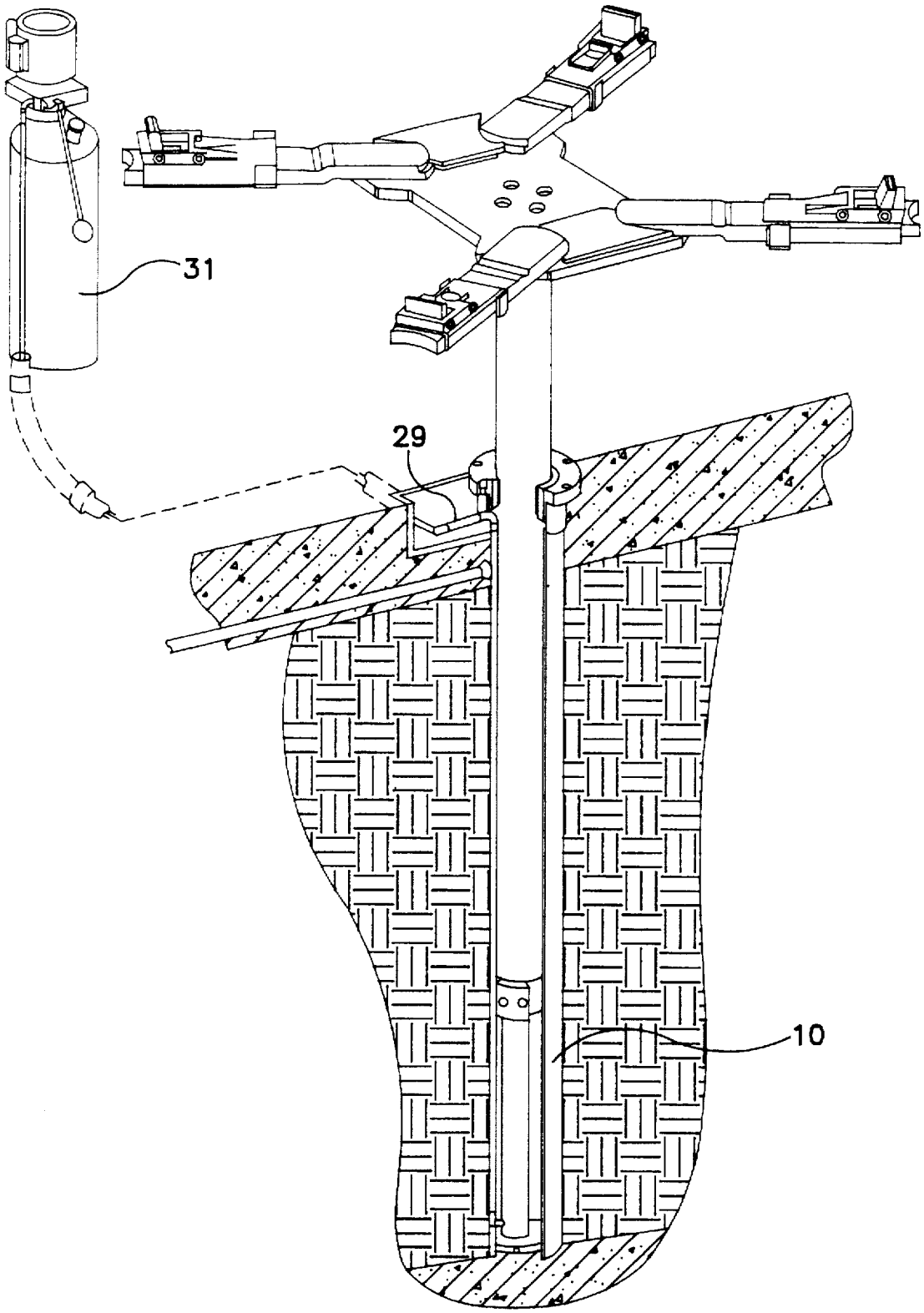
FIG. 9 is a perspective view of a completed retrofit, utilizing plunger mounted and gland flange mounted bearing means in accordance with the present inventive method.
Figure 9A:
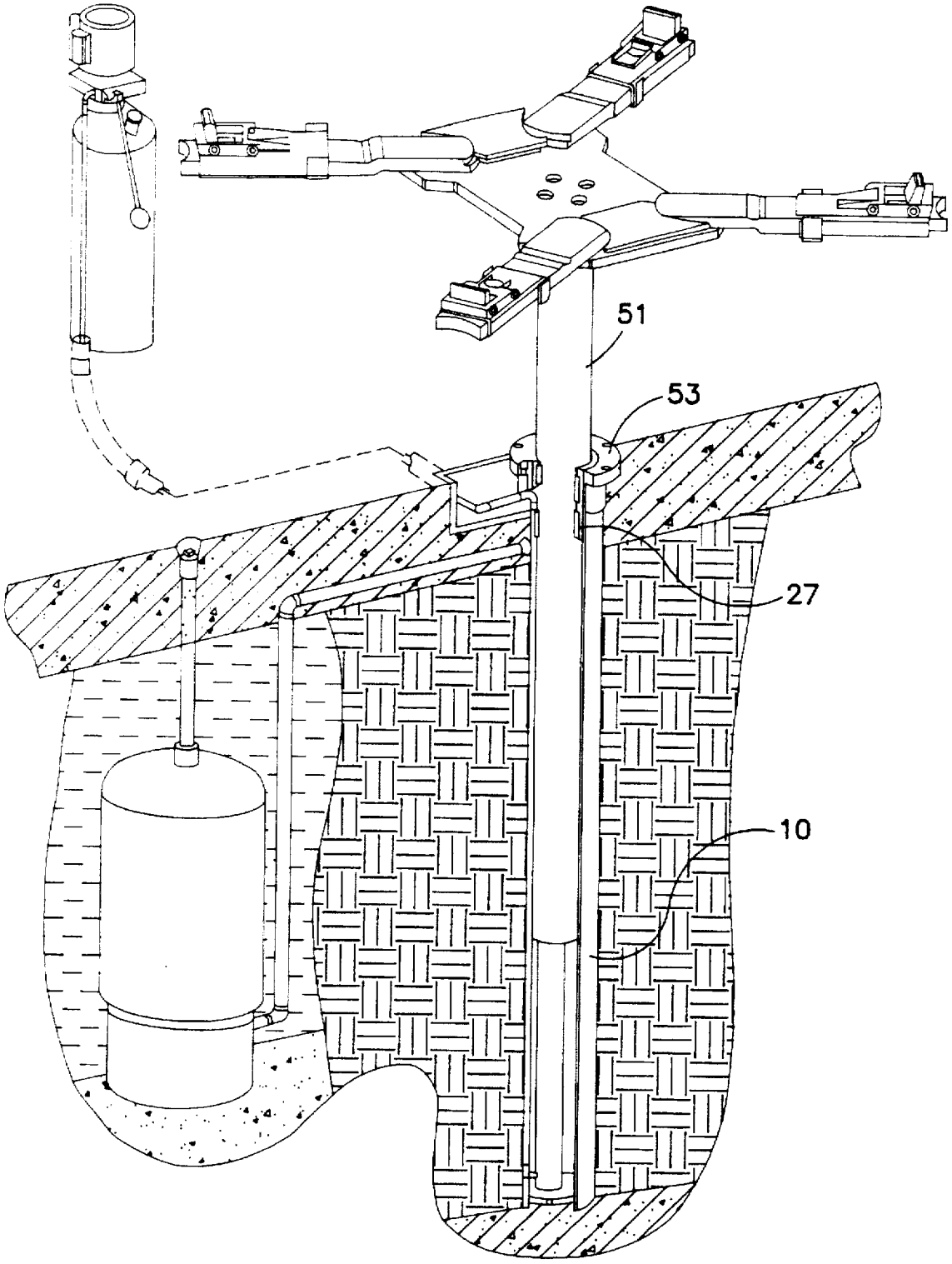
FIG. 9A is a perspective view of a completed retrofit, utilizing gland flage only mounted bearing means in accordance with the present inventive method.

In FIG. 8 is shown the addition of the original superstructure 20 to top 56 of piston 32 and plunger 50. FIG. 9 is a perspective break-away view of FIG. 8 which also shows power unit 31.

Figure 10:
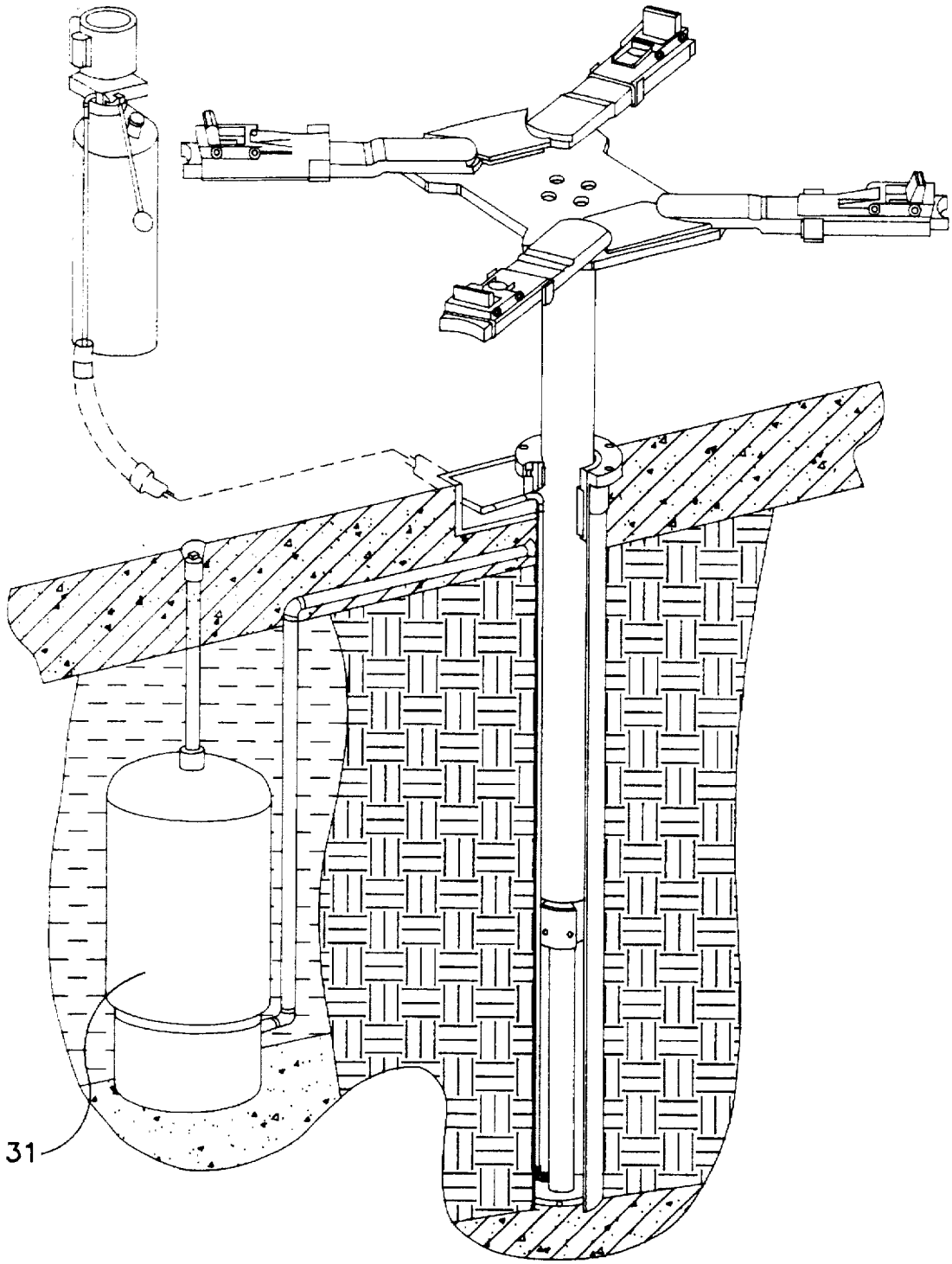
FIG. 10 is a perspective view showing in-ground placement of the pre-existing hydraulic tank and associated tubes, used as a breather system.

With reference to FIG. 10, the present method of retrofit may be seen to include the placement of the pre-existing hydraulic tank 31 and associated tubes used as a breather system.

Figure 10A:
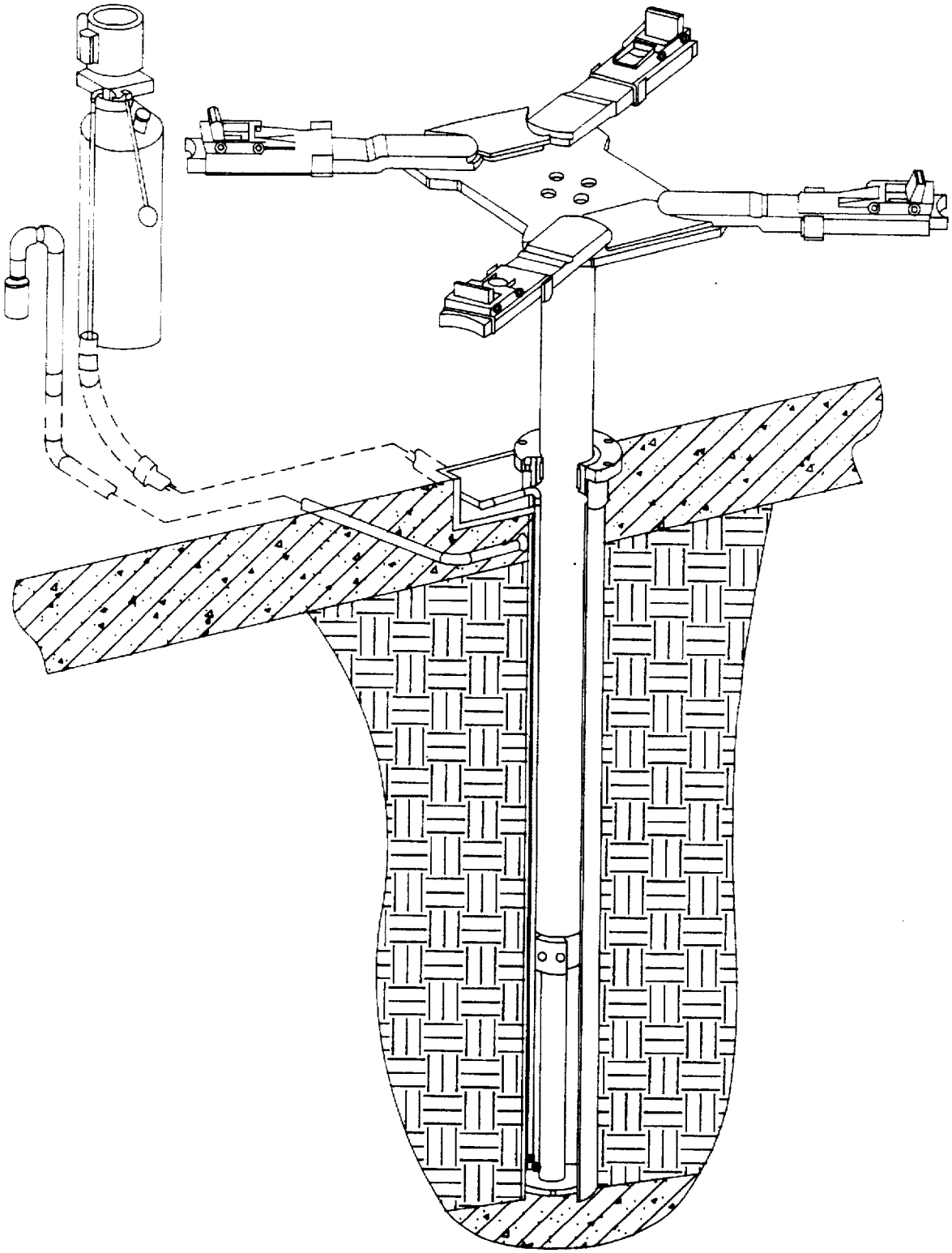
FIG. 10A is a perspective view showing in-ground placement of a newly installed breather system using the pre-existing hydraulic connection port as the connection point to the pre-existing lift casing.

With reference to FIG. 10A, the present method of retrofit may alternately include the placement of tubes of any suitable composition to be used as a breather system.

Because the resultant new system operates with 97% less fluid, any leak immediately stops the function thereof. Oil leaked will reside at the bottom of the casing (not under pressure as in prior art systems) and can be easily removed, the fluid expelled, and the cylinder repaired or replaced in 1–2 hours, with the lift then operational the same day. The new system requires no maintenance, while prior systems require lubrication of plunger/flange assembly. As such, the new system should operate much longer with fewer problems. Prior systems require seals at the top of the casing to prevent fluid from leaking out. These seals frequently failed over time. Such new systems will function more smoothly since there is no air-over-oil operation.

In summary, the new system of the instant method of retrofit is:

1. Environmentally sound.
2. Cost effective to retrofit.
3. Minimizes shop disruption.
4. Does not expose existing soil.
5. Operates better.
6. Easier to repair.
7. Easier to maintain.
8. Longer lasting.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention what I claim as new, useful and non-obvious and, accordingly, secure by Letters Patent of the United States is:

1. A method of retrofit of a pre-existing in-ground automotive lift system, the method comprising the steps of:

(a) removal of a superstructure of the pre-existing system;

(b) excavation of any solid structure surrounding the lift casing of the pre-existing system;

(c) evacuation of hydraulic fluid of the pre-existing system;

(d) removal of guide means associated with a plunger of the pre-existing structure;

(e) removal of said plunger of the pre-existing system;

(f) within the casing of the pre-existing system, installation of a self contained or sealed high pressure, low volume hydraulic cylinder and associated hydraulic lines;

(g) installation of a power unit for said high pressure, low volume hydraulic cylinder;

(h) installation of a plunger associated with said high pressure low volume cylinder using said casing as an outer guide means for said plunger; and (i) replacement of the superstructure of the pre-existing system.

2. The method as recited in claim 1, further comprising the step of:

mechanically locking said high pressure hydraulic cylinder to a surface of said lift casing of the pre-existing system.

3. The method as recited in claim 2, further comprising the step of:

providing an upper bearing structure between an upper surface of said plunger and the re-inserted guide means of the pre-existing system.

4. The method as recited in claim 1, in which said installation Step (f) includes the step of:

providing a mounting means for interface between peripheral geometries of the preexisting system said high pressure cylinder.

5. The method as recited in claim 1, in which said installation Step (g) includes the step of:

providing a hydraulic tank and selectably actuatable pump means associated therewith.

6. The method as recited in claim 4, further comprising the step of:

providing a secondary containment about said high pressure hydraulic cylinder.

7. The method as recited in claim 6, further comprising the step of:

providing a secondary containment about said hydraulic lines associated with said high pressure cylinder.

* * * * *

UNITED STATES PATENT AND TRADEMARK OFFICE

CERTIFICATE OF CORRECTION

PATENT NO. : 5,740,886

DATED : April 21, 1998

INVENTOR(S) : FLETCHER, Robert H.

It is certified that error appears in the above-identified patent and that said Letters Patent is hereby corrected as shown below:

at column 1, line 41, and column 3, line 31, each occurrence, "inground" should read —in-ground—;

at column 1, line 62, "mounts" should read —amounts—;

at column 2, line 38, "to," should read —to—; and at column 2, line 57, "vacinity," should read —vicinity—.

Signed and Sealed this

Twenty-seventh Day of October, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,740,886

DATED : April 21, 1998

INVENTOR(S) : Robert H. Fletcher

It is certified that error appears in the above-indentified patent and that said Letters Patent is hereby corrected as shown below:

Col. 3, line 3, insert --the invention-- between "of" and "to".

Col. 3, line 63, change "flage" to --flange--.

Col. 5, line 7, after "upper" insert --bearing--;
Col. 5, line 9, change "new bearing housing" to --upper bearing structure--.

<u>In the Claims</u>

Claim 4, col. 6, line 42, insert --and-- between "preexisting system" and "said high pressure cylinder".

Signed and Sealed this

Twenty-eighth Day of September, 1999

*Attest:*

Q. TODD DICKINSON

*Attesting Officer*

*Acting Commissioner of Patents and Trademarks*